US007222503B2

(12) United States Patent
Golove

(10) Patent No.: US 7,222,503 B2
(45) Date of Patent: May 29, 2007

(54) RING WITH INTERCHANGEABLE SETTINGS AND ATTACHABLE CHARMS AND METHODS FOR THEIR USE

(76) Inventor: Beth Golove, 48 Rose St., Smithtown, NY (US) 11787

( * ) Notice: Subject to any disclaimer, the term of this patent is extended or adjusted under 35 U.S.C. 154(b) by 43 days.

(21) Appl. No.: 11/061,809

(22) Filed: Feb. 18, 2005

(65) Prior Publication Data

US 2006/0185392 A1 Aug. 24, 2006

(51) Int. Cl.
*A44C 25/00* (2006.01)
*A44C 9/00* (2006.01)

(52) U.S. Cl. ..... 63/33; 63/15; 63/40

(58) Field of Classification Search ..... 63/15, 63/15.1, 15.2, 15.3, 15.4, 15.45, 15.5, 15.6, 63/15.65, 15.8, 15.9, 29.1, 29.2, 30, 23, 40; D11/26–34

See application file for complete search history.

(56) References Cited

U.S. PATENT DOCUMENTS

| | | | | |
|---|---|---|---|---|
| 296,312 | A | 4/1884 | Bulova | |
| 359,717 | A | 3/1887 | Dreyfus | |
| 367,414 | A | 8/1887 | Lamont | |
| 417,569 | A | 12/1889 | Margileth | |
| 466,287 | A | 12/1891 | Berlepsch | |
| 732,532 | A | 6/1903 | Fallek | |
| 758,848 | A * | 5/1904 | Pejchar | 63/12 |
| 1,166,431 | A | 1/1916 | Capwell | |
| 1,176,028 | A | 3/1916 | Botfield | |
| 1,179,025 | A | 4/1916 | Molinaro | |
| 1,308,011 | A | 6/1919 | Gilsey | |
| 1,691,445 | A | 11/1928 | Meliodon | |
| 1,877,442 | A | 9/1932 | Armstrong | |
| 2,074,643 | A | 3/1937 | Domenego | |
| D109,800 | S * | 5/1938 | Foss | D11/32 |
| 2,316,225 | A | 4/1943 | de Hoffman et al. | |
| 2,354,513 | A | 7/1944 | Fitzer | |
| 2,586,787 | A | 2/1952 | Conto et al. | |
| 2,883,048 | A | 4/1959 | Lentz | |
| 3,039,279 | A | 6/1962 | Bussel | |
| 3,115,758 | A | 12/1963 | Eberle et al. | |
| 3,180,112 | A * | 4/1965 | Lefkowitz | 63/29.1 |
| 3,273,766 | A | 9/1966 | Consentino | |
| 3,643,467 | A | 2/1972 | Postel | |

(Continued)

OTHER PUBLICATIONS

Google Images. Search results for "charm rings," results 1-20. (2 pages).
Price, Jodi. "Beadworx.com—Lampwork Charm Rings by Jodi Price." GlassArtists.org. Catalog cover. (2 pages).
"Charm Rings" JF Designs Jewelry. Catalog. (1 page).
Shop Intuition charm rings, 2004. Catalog. (1 page).
"Initial Charm Ring," Earth's Treasure, 2005. Catalog. (4 pages).

*Primary Examiner*—Jack W. Lavinder
(74) *Attorney, Agent, or Firm*—Gordon & Jacobson, PC

(57) ABSTRACT

An item of jewelry includes a ring having a removable setting and a charm coupled to a short chain. The removable setting is removably coupled to a post upon which the chain carrying the charm can be attached. According to the presently preferred embodiment, the post is threaded and the setting has internal matching threads. The chain is preferably short enough so that when it is attached to the post, the charm does not hang between the wearer's fingers. The charms are preferably provided in a wide range of designs, including, but not limited to holiday themes, religious themes, astrological signs, varsity letters, graduation year, wedding themes, commercial characters such as Disney characters, TV characters, messages such as "I Love You", etc. The interchangeable settings may include different color stones to match different color clothing, birth stones, etc.

16 Claims, 3 Drawing Sheets

U.S. PATENT DOCUMENTS

| | | | |
|---|---|---|---|
| 3,739,598 | A | 6/1973 | Postel |
| 3,751,795 | A | 8/1973 | Favre |
| 4,216,567 | A | 8/1980 | Heinz |
| 4,259,850 | A | 4/1981 | Lalieu |
| 4,353,124 | A | 10/1982 | Weinzettel et al. |
| 4,353,225 | A | 10/1982 | Rogers |
| 4,519,220 | A | 5/1985 | Burrell |
| 4,794,766 | A | 1/1989 | Schunk et al. |
| 4,879,882 | A | 11/1989 | Johnson et al. |
| 4,936,115 | A | 6/1990 | Mesica |
| 4,982,581 | A | 1/1991 | Furuyama |
| 5,018,365 | A | 5/1991 | Luceno |
| 5,022,237 | A | 6/1991 | Monderer et al. |
| 5,077,987 | A | 1/1992 | Leith, III |
| 5,077,989 | A | 1/1992 | Dillabaugh |
| 5,097,679 | A | 3/1992 | Johnson et al. |
| 5,115,649 | A | 5/1992 | Amber |
| 5,456,095 | A | 10/1995 | Tawil et al. |
| 5,887,448 | A | 3/1999 | Gilbert et al. |
| 5,987,919 | A | 11/1999 | Hooser |
| 5,992,177 | A | 11/1999 | Beard |
| 6,032,485 | A | 3/2000 | Steinberg |
| 6,053,009 | A | 4/2000 | Broggian |
| 6,116,054 | A | 9/2000 | Czupor |
| 6,164,292 | A | 12/2000 | Di Maria Poole et al. |
| 6,357,261 | B1 | 3/2002 | Cheng |
| 6,370,912 | B1 | 4/2002 | Sutton |
| 6,408,647 | B1 | 6/2002 | Koll |
| 6,412,304 | B1 | 7/2002 | Adelman |
| 6,415,629 | B1 | 7/2002 | Chan |
| 6,581,413 | B1 | 6/2003 | Kadosh |
| 6,698,238 | B1 | 3/2004 | Cheng |
| 6,763,681 | B1 | 7/2004 | Klundt |
| 6,810,685 | B2 | 11/2004 | Esposito, Jr. |
| 2002/0020191 | A1 | 2/2002 | Chan |
| 2004/0177647 | A1 | 9/2004 | Dennis |

* cited by examiner

RING WITH INTERCHANGEABLE SETTINGS AND ATTACHABLE CHARMS AND METHODS FOR THEIR USE

BACKGROUND OF THE INVENTION

1. Field of the Invention

This invention relates broadly to jewelry. More particularly, this invention relates to a ring having interchangeable settings and attachable charms.

2. State of the Art

Jewelry is a very popular accessory, particularly among women and girls. Finger rings, bracelets and necklaces are the most popular jewelry items. Rings typically have one or more settings which carry precious or semi-precious stones. Bracelets and necklaces sometimes have hanging pendants or charms. Charm bracelets are unique in that one typically collects charms to be added to the bracelet over time. The charms usually commemorate some event, holiday, milestone, etc. Once added to the bracelet, however, charms generally are not easily removed. Eventually, the bracelet becomes full of charms and no more can be added.

SUMMARY OF THE INVENTION

It is therefore an object of the invention to provide a new and interesting item of jewelry.

It is another object of the invention to provide an item of jewelry which combines features of rings and bracelets.

It is a further object of the invention to provide an item of jewelry which is easily adaptable to suit the whim of the wearer.

In accord with these objects, which will be discussed in detail below, an item of jewelry according to the invention includes a finger ring having a removable setting and a charm coupled to a short chain which is captured on the ring by the setting. The removable setting is removably coupled to a post upon which the chain carrying the charm can be attached. According to the presently preferred embodiment, the post is threaded and the setting has internal matching threads. The chain is preferably short enough so that when it is attached to the post, the charm does not hang between the wearer's fingers. The charms are preferably provided in a wide range of designs, including, but not limited to holiday themes, religious themes, astrological signs, varsity letters, graduation year, wedding themes, commercial characters such as Disney characters, TV characters, messages such as "I Love You", etc. The interchangeable settings may include different color stones to match different color clothing, birth stones, etc., or may provide different motifs such as initials.

Additional objects and advantages of the invention will become apparent to those skilled in the art upon reference to the detailed description taken in conjunction with the provided figures.

DETAILED DESCRIPTION OF THE PREFERRED EMBODIMENT

Figure 1:
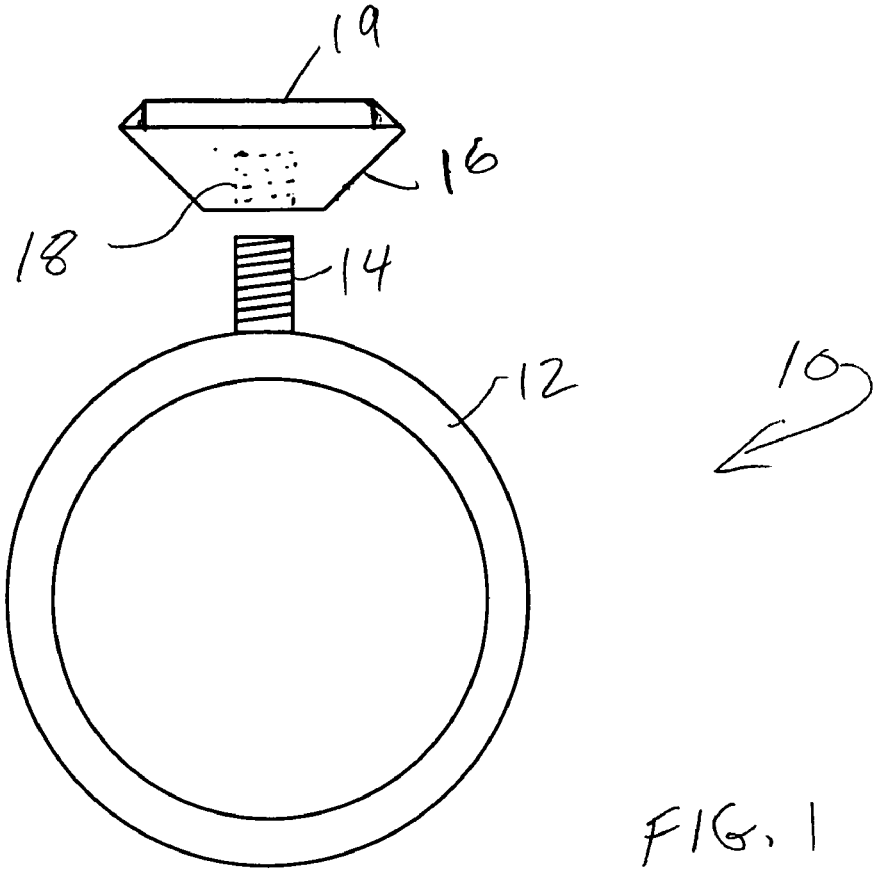
FIG. 1 is a schematic exploded side elevation view of a ring according to the invention.

Turning now to FIG. 1, a finger ring 10 according to the invention includes a closed loop 12 which is dimensioned to fit comfortably over the wearer's finger, a radially outward extending threaded post 14, and a setting 16 having internal threads 18. The setting 16 preferably receives and holds a precious or semi-precious stone 19. As used herein, the term "stone" means something held by a setting for display. It is not necessarily a precious or semi-precious gemstone or even a simulation of a gemstone, as it may be a precious or other metal providing a decoration or motif, glass, crystal, etc. If desired, a safety latch (not shown) can be provided to latch the setting to the ring and/or stem.

From the foregoing, those skilled in the art will appreciate that the setting 16 is removable from and attachable to the post 14. Thus, a plurality of settings holding different stones may be interchangeably attached to the post 14 resulting in different style rings. The stones in the interchangeable settings may include different color stones to match different color clothing, birth stones, etc., or a metal "stone" with a motif or decoration. Settings which hold multiple stones may also be used. The settings are preferably made from a precious metal such as silver, gold, or platinum. However, in order to provide a ring affordable by teenage or younger girls, the settings can be made of "white metal" and the stones can be made of inexpensive materials including metal, glass or plastic.

Figure 2:
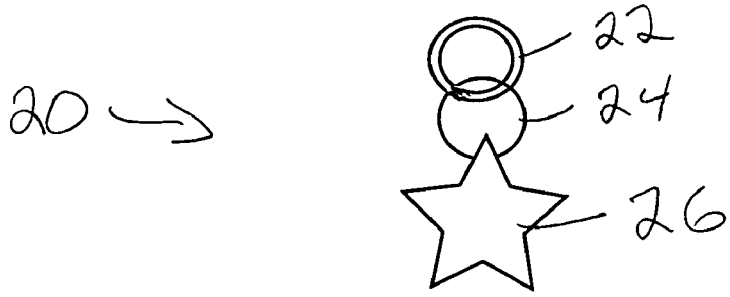
FIG. 2 is a schematic side elevation view of a charm according to the invention.

Referring now to FIG. 2, a charm 20 according to the invention includes a loop 22 coupled by one or more chain links or loops 24 to a charm element 26, in the illustrated embodiment, a star. According to the invention, the charms are preferably provided in a wide range of designs, including, but not limited to holiday themes, religious themes, astrological signs, varsity letters, graduation year, wedding themes, commercial characters such as Disney characters, TV characters, messages such as "I Love You", etc.

Figure 3:
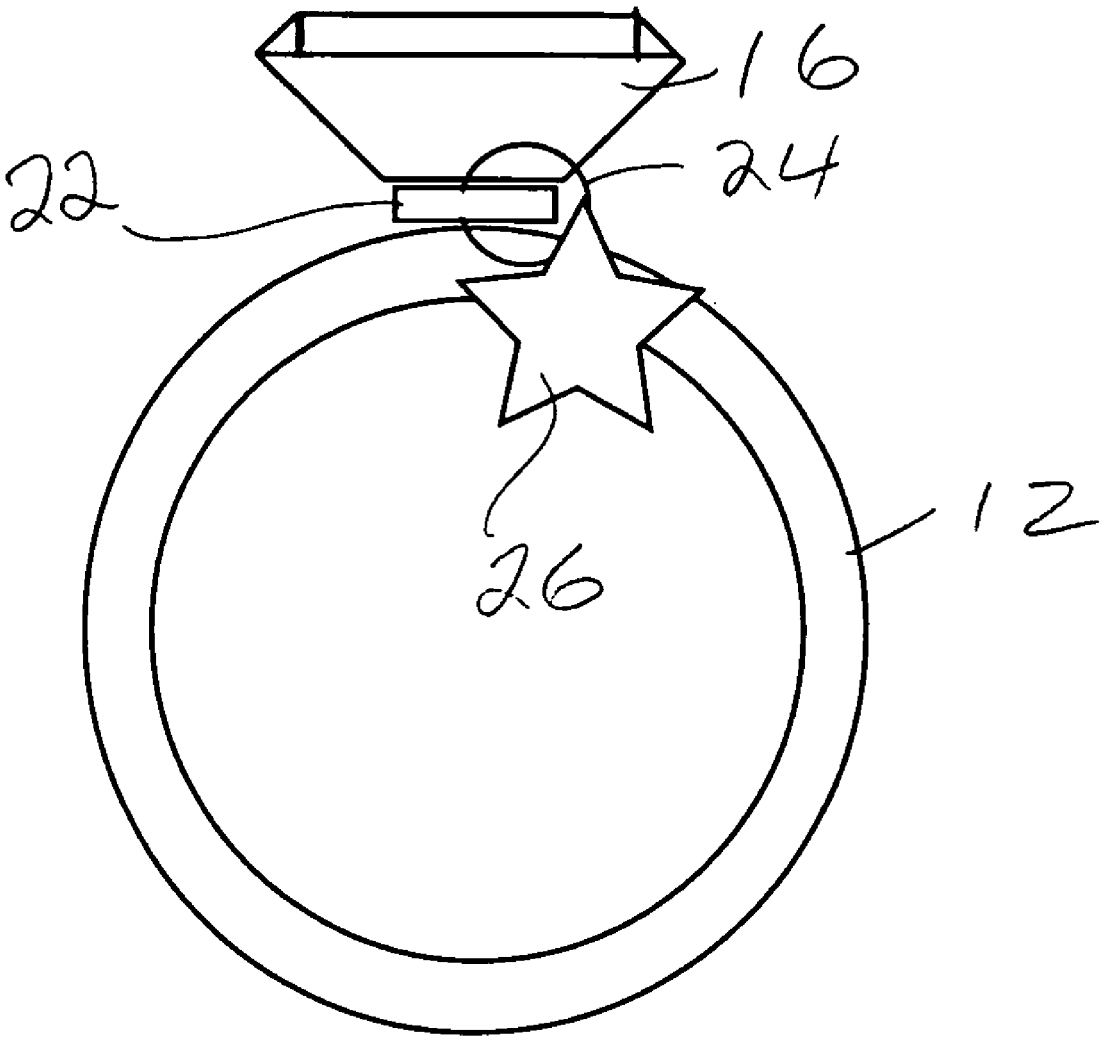
FIG. 3 is a schematic side elevation view of the charm attached to the ring.
Figure 4:
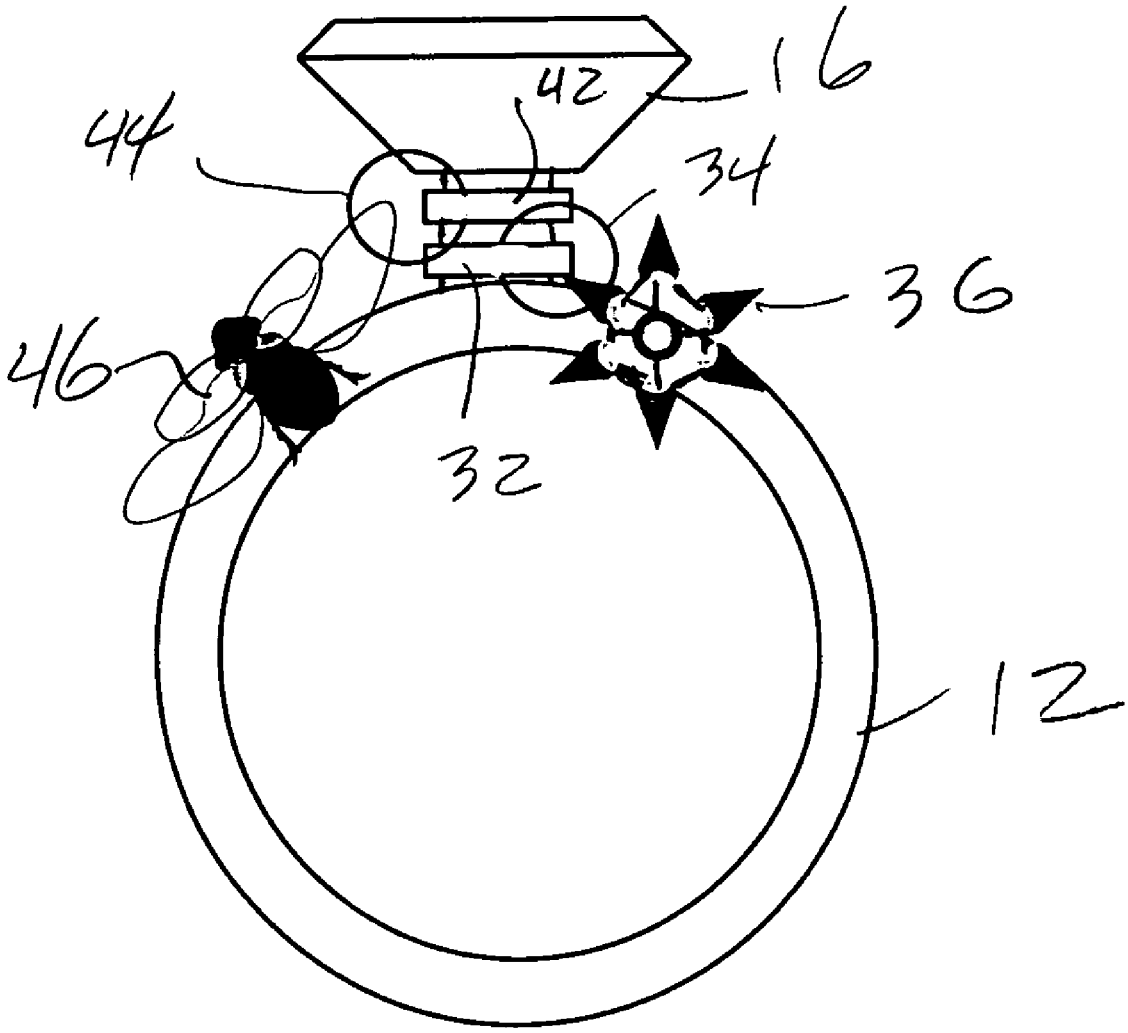
FIG. 4 is a view similar to FIG. 3 showing multiple charms attached to the same ring.

Turning now to FIG. 3 and with reference to FIGS. 1 and 2, according to the methods of the invention, the setting 16 is separated from the post 14 as shown in FIG. 1. The loop 22 of the charm 20 is placed over the post 14 and the setting is 16 is reattached to the post as shown in FIG. 3. The chain link(s) 24 form(s) a chain which is preferably short enough so that when it is attached to the post, the charm does not hang between the wearer's fingers. According to the preferred methods of the invention, up to three charms may be attached to the ring at any one time. FIG. 4 shows a ring with two charms 36 and 46 each coupled to a chain link 34, 44 coupled to a loop 32, 42. The loops 32, 42 are positioned over the post as shown with the setting on top. It will be appreciated that in order to accommodate multiple charms, the post may need to be elongated beyond the depth of the internal threads in the setting. If this is the case, blank spacer loops (i.e. without a charm) may be provided to cover exposed portions of the stem when fewer than the maximum number of charms are attached.

There have been described and illustrated herein several embodiments of an item of jewelry and methods of assembling it. While particular embodiments of the invention have been described, it is not intended that the invention be limited thereto, as it is intended that the invention be as broad in scope as the art will allow and that the specification be read likewise. Thus, while the ring has been described and illustrated as having a threaded post and a setting with matching internal threads, other mating means could be used to couple/uncouple the setting and the ring. While the charm has been described as coupled to a loop by a chain link, the charm could be directly coupled to the loop. Although it is presently preferred that no more than three charms be attached to the ring, it is within the scope of the claims that more than three charms be attached. Further, while the ring has been described as a finger ring, it is intended that the application be broad enough to encompass a toe ring as well. Further yet, while the invention was described as including a "setting" and a "stone", it will be appreciated by those skilled in the art that the "setting" and "stone" may be integral with each other. By way of example and not limitation, a stone (particularly metal or plastic) may be provided with threads such that the threads act as the setting for purposes of attaching to the threaded post. It will therefore be appreciated by those skilled in the art that yet other modifications could be made to the provided invention without deviating from its spirit and scope as claimed.

What is claimed is:

1. An item of jewelry, comprising:

a finger ring having a radially outward extending post with a first mating element;

a setting or stone having a second mating element removably coupled to said first mating element; and a plurality of charms, each charm having a loop, each loop engaging said post and captured on said post between said finger ring and said setting with said charms being independently removable from said finger ring by removing said loops from said post.

2. An item of jewelry according to claim 1, wherein:

said setting or stone comprises a setting having said second mating element and a stone displayed by said setting.

3. An item of jewelry according to claim 1, wherein:

said first mating element includes threads on said post and said second mating element includes internal threads in said setting or stone.

4. An item of jewelry according to claim 1, wherein:

said charm is selected from the group consisting of holiday themes, religious themes, astrological signs, varsity letters, graduation year, wedding themes, commercial characters such as cartoon characters, TV characters, messages such as "I Love You".

5. A kit comprising:

a finger ring having a radially outward extending post with a first mating element;

at least one setting or stone having a second mating element removably coupled to said first mating element; and a plurality of charms, each charm having a loop, wherein said charm is moveable relative to it's loop, said loops are for engaging said post between said finger ring and said setting or stone and being independently removable from said post.

6. A kit according to claim 5, wherein:

said at least one setting or stone comprises at least one stone held by a setting.

7. A kit according to claim 5, wherein:

said at least one setting or stone includes a plurality of settings or stones each having a respective second mating means.

8. A kit according to claim 5, wherein:

said charm is selected from the group consisting of holiday themes, religious themes, astrological signs, varsity letters, graduation year, wedding themes, commercial characters such as cartoon characters, TV characters, messages such as "I Love You".

9. A method of decorating an item of jewelry which includes a finger ring having a radially outward extending post with a first mating element and a setting or stone having a second mating element removably coupled to said first mating element, said method comprising:

with the setting separated from the post, slipping a plurality of loops over the post, each loop being coupled to a charm and independently removable from the post; and attaching the setting or stone to the post capturing the loop between the ring and the setting or stone.

10. A method according to claim 9, further comprising:

removing the setting or stone and adding an additional charm by slipping a loop over the post, the loop being coupled to the additional charm; and attaching the setting to the post capturing the two loops between the ring and the setting or stone.

11. A method according to claim 9, further comprising:

removing the setting or stone;

removing the charm by slipping a loop off the post;

attaching a different charm by slipping a loop over the post, the loop being coupled to the different charm; and attaching the setting or stone to the post capturing the loop between the ring and the setting or stone.

12. A method according to claim 9, wherein:

the charm is selected from the group consisting of holiday themes, religious themes, astrological signs, varsity letters, graduation year, wedding themes, commercial characters such as cartoon characters, TV characters, messages such as "I Love You".

13. In a jewelry system having a finger ring with a radially outward extending post with a setting or stone removably coupled to the post, the improvement comprising:

a plurality of charms, each charm having a loop which is captured on the post between the ring and the setting or stone and independently removable from the post.

14. In a system according to claim 13, wherein:

the system includes a stone held in the setting.

15. In a system according to claim 13, wherein:

the ring is a finger ring.

16. In a system according to claim 13, wherein:

said charm is selected from the group consisting of holiday themes, religious themes, astrological signs, varsity letters, graduation year, wedding themes, commercial characters such as cartoon characters, TV characters, messages such as "I Love You".

* * * * *